US008336285B2

(12) United States Patent
De Smet et al.

(10) Patent No.: US 8,336,285 B2
(45) Date of Patent: Dec. 25, 2012

(54) CORD FOR REINFORCEMENT OF A CEMENTITIOUS MATRIX

(75) Inventors: Anneleen De Smet, Kruishoutem (BE); Johan Vanbrabant, Zwevegem (BE)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 13/139,587

(22) PCT Filed: Dec. 9, 2009

(86) PCT No.: PCT/EP2009/066724

§ 371 (c)(1),
(2), (4) Date: Jun. 14, 2011

(87) PCT Pub. No.: WO2010/069837

PCT Pub. Date: Jun. 24, 2010

(65) Prior Publication Data

US 2011/0239905 A1 Oct. 6, 2011

(30) Foreign Application Priority Data

Dec. 18, 2008 (EP) ..... 08172080

(51) Int. Cl.
*D02G 3/36* (2006.01)

(52) U.S. Cl. ..... 57/241

(58) Field of Classification Search ..... 57/212, 57/223, 232, 236, 241
See application file for complete search history.

(56) References Cited

U.S. PATENT DOCUMENTS 3,086,273 A 4/1963 Welborn
5,307,615 A * 5/1994 Walton et al. ..... 57/214
5,597,514 A * 1/1997 Miksic et al. ..... 252/390
5,683,751 A * 11/1997 Derule et al. ..... 427/384
6,068,918 A * 5/2000 Van Der Veer et al. ..... 428/379
6,106,741 A * 8/2000 Heimann et al. ..... 252/389.3
6,276,120 B1 * 8/2001 Adriaensen et al. ..... 57/210
6,560,807 B1 5/2003 Stubler et al.
6,692,829 B2 2/2004 Stubler et al.
7,404,426 B2 * 7/2008 Akiyama et al. ..... 152/536

(Continued)

FOREIGN PATENT DOCUMENTS

EP 1 048 682 A 11/2000

(Continued)

OTHER PUBLICATIONS

D.G. Shitkow, "DRAHTSEILE", (1957), pp. 229-237, 241-263.

(Continued)

*Primary Examiner* — Shaun R Hurley
(74) *Attorney, Agent, or Firm* — Foley & Lardner LLP

(57) ABSTRACT

The invention relates a cord for the reinforcement of a cementitious matrix. The cord comprises number of coated metal filaments twisted together to form a cord. The cord shows cross-sections, whereby three or more of the filaments form a closed sub-structure having a void in the middle of the three or more filaments. The cord further comprises a protective compound whereby the protective compound is at least present in said void. The protective compound gives the coated metal element cathodic protection. The invention further relates to a structure comprising a number of cords such as a knitted, a braided, a welded or a glued structure. Furthermore the invention relates to a cementitious matrix reinforced with a cord according to the present invention and to a method to inhibit hydrogen gas evolution at the interface of a cord embedded in a cementitious matrix.

11 Claims, 2 Drawing Sheets

U.S. PATENT DOCUMENTS

Figure 1:
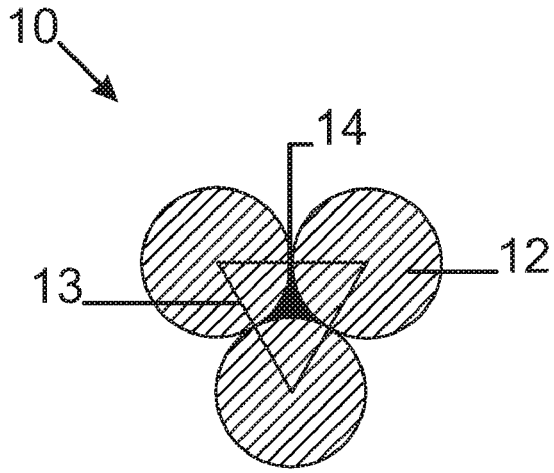

| | | | | |
|---|---|---|---|---|
| 2003/0106300 | A1 * | 6/2003 | Bruyneel et al. | 57/212 |
| 2008/0102294 | A1 * | 5/2008 | Kitajima et al. | 428/457 |
| 2010/0021759 | A1 * | 1/2010 | Lambrechts et al. | 428/624 |

FOREIGN PATENT DOCUMENTS

| | | | |
|---|---|---|---|
| EP | 1 211 350 | A1 | 6/2002 |
| FR | 2 798 408 | A | 3/2001 |
| JP | 53-78625 | A | 7/1978 |
| RU | 2009188 | C1 * | 3/1994 |
| WO | WO 98-31892 | A1 | 7/1998 |
| WO | WO 2006-067095 | A1 | 6/2006 |

OTHER PUBLICATIONS

T. Bellezze et al., "Effect of Chemical—Physical Interaction Between Galvanized Steel Fibres and Concrete", 6$^{th}$ RILEM Symposium on Fibre-Reinforced Concrete (FRC), Sep. 20-22, 2004; pp. 239-248.

* cited by examiner

CORD FOR REINFORCEMENT OF A CEMENTITIOUS MATRIX

TECHNICAL FIELD

The invention relates to a cord for reinforcement of a cementitious matrix having a protective compound present at least in the voids of the cord and to a structure comprising a number of such cords.

The invention further relates to a reinforced cementitious matrix comprising at least such a cord. Furthermore, the invention relates to a method for inhibiting hydrogen gas evolution.

BACKGROUND ART

It is generally known to reinforce concrete structures with metal elements, such as steel fibers, to give the structures the required mechanical properties.

As bare steel elements may suffer from corrosion, galvanized steel elements have been proposed to give the steel elements a long term corrosion resistance. Galvanized reinforcing steel elements are especially useful for the reinforcement of concrete for construction purposes whereby the reinforced concrete will be exposed to the weather before construction begins, as for example in prefabrication construction.

However, the use of galvanized steel elements in concrete is creating problems: during hardening of the concrete, the galvanized surface of the steel elements will react with the alkaline environment of the concrete to form zinc salts accompanied by hydrogen gas evolution. This is an effect that appears when a strong electronegative element like zinc, aluminum or magnesium is exposed to water. The element has an open circuit potential as defined in the standard ASTM G 15-93. At high pH values, the open circuit potential drops below the hydrogen evolution potential and hence initiates the reduction of hydrogen ions resulting in hydrogen gas evolution.

Hydrogen gas evolution leads to strength and durability problems, as well as to aesthetical problems. Due to hydrogen gas evolution at the interface of the metal elements and the concrete, the bond strength between the metal elements and the concrete is reduced. This is resulting in a reduction of the strength of the reinforced concrete. The durability problem is the result of the reduction in the thickness of the alloy coating due to the reaction of the alloy coating in the alkaline environment. The alloy coating may e.g. be zinc, aluminum or magnesium.

The problems of galvanized steel elements in concrete are described in "Effect of chemical-physical interaction between galvanized steel fibres and concrete", T. Belleze, R. Fratesi, C. Failla, 6th RILEM Symposium on Fibre-Reinforced Concretes (FRC) BEFIB 2004, 20-22 Sep. 2004, 239-248.

To prevent hydrogen gas evolution the surfaces of galvanized steel elements can be passivated. This can be realised by treating the galvanized steel elements with a chromium based compound. Also the chromate naturally present in the concrete can be sufficient to protect the galvanized steel elements.

However, in recent years it has been recognized that hexavalent chromium raises serious environmental and health problems. Consequently, strict restrictions have been placed on the quantity of hexavalent chromium used in a number of industrial processes and products as for example cement and concrete.

Other attempts to protect galvanised steel comprise the application of an epoxy coating on the galvanised steel. The use of galvanised steel coated with an epoxy coating to reinforce concrete is for example described in JP 53-078625. However, epoxy coatings have serious drawbacks as epoxy coatings act a barrier against a corrosive environment. If there are defects in the epoxy coating through which aggressive agents can penetrate the barrier, corrosion will concentrate on these areas. Local corrosion could make the steel element break where the coating is damaged. Integrity of the epoxy coating is therefore essential as the film must be free from pores, cracks and damaged areas. Epoxy coatings are fragile. Epoxy coated metal elements must therefore be handled with a lot of care during storing, transport and handling. Consequently, as the mixing or installation of the reinforcement elements in the concrete is a rough operation whereby local damages on the surface of reinforcement elements are unavoidable, the use of epoxy coated metal elements or other compounds applied at the surface for the reinforcement of concrete is not a good option.

Many corrosion inhibitors known in the art such as phosphates, silicates, silanes, carbonates and carbonic acids, sulfides and mercaptoderivates, amines and sulfonates have been tested. However, these inhibitors did not give an adequate result as they were not able to avoid hydrogen gas evolution.

Therefore, obtaining an adequate protection of steel elements, and coated metal elements in general, without using chromium compounds and not requiring a 100% closed barrier coating remains to be a problem and efficient solutions are still needed.

WO2006067095A1 by Applicant describes a reinforced structure comprising a cementitious matrix and zinc coated metal elements, wherein said reinforced structure is treated at the interface of said zinc coated metal elements and said cementitious matrix with a compound giving said zinc coated metal element cathodic protection. The compound is selected from the group consisting of the imidazoles, the triazoles and the tetrazoles, whereby said imidazole comprises benzimidazole (BZI).

However, a sufficient amount of compound needs to be applied to the surface to be effective against hydrogen gas evolution. Not only is the process for applying a sufficient amount of compound to the surface of e.g. a zinc coated metal element industrially very difficult, said elements must also be handled with a lot of care during storing, transport and handling to prevent damage to the surface.

DISCLOSURE OF INVENTION

It is an object of the present invention to provide a cord for the reinforcement of a cementitious matrix.

It is another object to provide a structure comprising at least one such cord.

It is also an object of the invention to provide a cementitious matrix reinforced with at least one such cord.

Furthermore, it is an object of the invention to provide a method for inhibiting hydrogen gas evolution at the interface of such a cord with a cementitious matrix.

According to a first aspect of the present invention a cord for the reinforcement of a cementitious matrix is provided. The cord comprises a number of coated metal filaments twisted together to form the cord. When looking now upon the cord as a geometrical arrangement, a series of cross-sections with a plane perpendicular to the axis of the cord can be envisaged. Within such a cross-section sub-structures of neighbouring filaments that surround a void can be discerned. The filaments remain neighbours to one another as the plane progresses along the axis of the cord. These sub-structures rotate one revolution for each lay length the perpendicular plane progresses along the axis of the cord. The presence of such sub-structures depends on the way the filaments are added into the cord in an arrangement that is commonly called the 'construction' of the cord. Within a cross-section of a cord according to the present invention at least one closed sub-structure is present. Within a closed sub-structure the neighbouring filaments are maximum 100 μm remote from neighbouring filaments, i.e. the outer surfaces of neighbouring filaments of a closed sub-structure are maximum 100 μm remote from neighbouring filaments. More preferably the neighbouring filaments of a closed sub-structure are maximum 30 μm, 20 μm, 10 μm, 5 μm or 2 μm remote from neighbouring filaments, the touching to one another of course not being excluded. When such touching occurs it will occur over a substantial length of the cord and is therefore called a 'line contact'.

Besides the filaments, the cord also comprises a protective compound. For the purpose of this invention with 'protective compound' is meant any compound giving the coated metal elements cathodic protection. The protective compound is preferably selected from the group consisting of the imidazoles, the triazoles and the tretrazoles.

The main function of the protective compound is to avoid the hydrogen gas evolution at the interface of the coated metal elements and the cementitious matrix during the mixing, pouring, setting and/or hardening of the reinforced structure. Therefore, it is important that the protective compound is present at the interface of the coated metal filaments with the cementitious matrix.

The critical period in which the galvanized surface of the metal elements needs protection is the period in which the cementitious matrix is hardening, i.e. the first 24 hours till the first 72 hours after casting.

In a preferred embodiment of the present invention the protective compound comprises an imidazole such as a silyl-imidazole or benzimidazole. A preferred silyl-imidazole comprises N-(trimethylsilyl)-imidazole; a preferred benzimidazole comprises 2-mercaptobenzimidazole or 2-mercapto-1-methylbenzimidazole.

As mentioned above it is important that the protective compound is present at the interface of the coated metal filaments with the cementitious matrix and this during the hardening of the cementitious matrix. To sufficiently protect the coated metal filaments it is necessary that a high amount of protective compound is present at the coated metal filaments and in particular at the interface of the coated metal filaments with the cementitious matrix.

These problems are solved by providing a cord whereby the protective compound is at least present in the void or voids of one or more of the closed sub-structures of the cord.

The protective compound within the void or voids creates a compound container-effect. The advantage of this compound container-effect is that more protective compound can be stored in the core. Furthermore, as more protective compound can be stored, the protective compound can be transported for example by means of diffusion towards the outer periphery of the cord when the cord is brought in contact with a cementitious matrix. Even if no protective compound is present at the outer periphery of the cord when the cord is introduced in the cementitious matrix, for example because no protective compound was applied at the outer periphery of the cord or because due to storing, transporting and/or handling of the cord, the protective compound is removed, the protective compound will be present at the interface coated metal filaments—cementitious matrix as the protective compound will transport for example by means of diffusion towards the outer periphery of the cord.

According to the present invention, the protective compound is at least present in the void or voids of a closed sub-structure of the cord. In addition, the protective compound can be present on one or more filament(s) of the cord, for example on the filaments arranged in the outer periphery of the cord, i.e. the filaments that come in contact with the cementitious matrix once the cord is embedded in the cementitious matrix.

A compound container-effect is observed if the capacity of a cord to store protective compound is higher than the capacity of the cord to store protective compound on the total surface of the individual filaments of the cord.

For the purpose of this invention, the capacity of a cord to store protective compound is expressed by means of value c (container value) and is calculated according to the formula:

$$c=(x+y)/x$$

whereby x=the amount of protective compound that is applied on the total surface of the individual filaments of a cord (expressed in $g/m^2$);

y=the amount of protective compound that is stored in the void or voids of the sub-structure(s) of a cord (expressed in $g/m^2$).

x is independent of the diameter of the filaments and of the cord construction and corresponds with the amount of protective compound that is applied on a wire or on a filament.

In order to have a compound container-effect the value of y is greater than zero. In other words, in order to have a compound container-effect the value c is higher than 1. More preferably, the value c is higher than 1.5 and most preferably the value c is higher than 2 or even higher than 5 or higher than 10.

It is important to notice that the value c is independent from the construction of the cord.

For a person skilled in the art it is clear that the amount of protective compound that is applied on the total surface of the individual filaments of a cord (expressed in $g/m^2$) and the amount of protective compound that is stored in the void or voids of the sub-structure(s) of a cord (expressed in $g/m^2$) are dependent upon the concentration of the protective compound in the solution used to apply the protective compound. This concentration can range from 0 wt % to 100 wt %, whereby a concentration of 0% is meaning that no protective compound is present in the solution; whereas a concentration of 100% is meaning that pure protective compound is used. All other percentages are meaning that the protective compound is applied from a solution comprising protective compound. For the present invention, the concentration of the protective compound in the solution used is preferably ranging between 5 wt % and 100 wt % as for example ranging between 10 wt % and 50 wt % or between 10 and 20 wt %.

The value c is determined by double weighing. After the application of the protective compound on a predetermined length of cord, the cord is weighted. Subsequently, the protective compound is removed from the cord, for example by means of ethanol and the cord is weighted again.

The difference in weight corresponds with x+y (expressed in $g/m^2$). To determine y, the same double weighing technique is applied on a predetermined length of a filament or a wire. The difference in weight after application of the protective compound and after removal of the protective compound corresponds with the value x (expressed in $g/m^2$). This value x is independent of the diameter. By subtracting the x value in $g/m^2$ from x+y, y is determined.

To obtain a compound container-effect, it is important that the distance between neighbouring filaments of a sub-structure is within a certain range.

If the distance between neighbouring filaments is too high, the sub-structure will loose most of its protective compound. Therefore the distance between neighbouring filaments is preferably lower than 100 μm and more preferably lower than 30 μm, for example 20 μm, 10 μm, 5 μm or 2 μm.

There are a number of ways in which the sub-structures of claim 1 may appear in the cord. In any case the sub-structure will appear when at least three steel filaments—not necessarily of equal diameter—are twisted together. The at least three filaments are for example twisted together with the same lay direction and the same lay length. 'Lay direction' is defined as the helical disposition of the filaments of a strand or cord. The strand or cord has an 'S' or left-hand lay if, when held vertically, the spirals around the central axis of the strand or cord conform in direction of slope to the central portion of the letter 'S'; and 'Z' or right-hand lay if the spirals conform in direction of slope to the central portion of the letter 'Z'. 'Lay length' is defined as the axial distance required to make a 360 degree revolution of a filament in a strand or in a cord.

To describe the cord construction the sequence of manufacturing the cord is followed, i.e. starting with the inner most filament or strand and moving outwards. The full description of the cord is given by the following formula:

$$(N\times F)+(N\times F)+(N\times F)$$

whereby

N=number of strands;

F=number of filaments.

(when N or F equals 1, they should not be included)

The construction can be completed with the diameter of the filaments and is then given by the formula:

$$(N\times F)\times D+(N\times F)\times D+(N\times F)\times D$$

whereby D=nominal diameter of filaments, expressed in mm

A first preferred embodiment in this respect is when just three filaments are twisted together without giving them a mechanical preforming or bending i.e. a 3×1 construction. In this embodiment, the filaments pairwise remain in line contact with one another over substantially the entire length of the steel cord. A void is formed inbetween the three filaments. Likewise a 4×1 embodiment will show one or two voids depending on whether the filament centers are arranged substantially square (one void) or diamond (two voids) like. Likewise, a 5×1 embodiment will show one, two or three voids and the 6×1 embodiment will show from one to four voids, depending on how the filaments are arranged.

When progressing to seven filaments the most stable and preferred arrangement is when one filament is centrally positioned, while the other filaments surround this centre filament. In principle, only at infinite lay length and perfectly equal diameters of the filaments, the voids will be entirely closed and full line contacts will form. Twisting these filaments in a finite lay will result in separation from the outer filaments from the centre filament leading to distances that can easily be held below 30 μm. Likewise it can be beneficial to make the centre filament thicker than the six surrounding filaments to even the load distribution on the different filaments. Again this incremented diameter can be kept low enough such that the gaps formed between the outer filaments remain below 30 μm. When the number of filaments is further increased, some numbers will stand out as being particularly stable to manufacture:

- 12 filaments of substantially equal diameter twisted together in one operation with one lay length and direction with a triplet in the middle and surrounded by 9 filaments, forming 13 voids in between them.
- 15 filaments, with a small filament in the middle, surrounded by 5 nearest neighbours, on its turn surrounded by an outer shell of 10 and twisted together in one single step thus forming 20 voids in between them. The cord has an envelope of roughly pentagonal shape.
- 19 filaments, all of substantially equal diameter twisted together in one single step with identical lay direction and lay length, with a single filament in the middle surrounded by a first shell of 6 filaments that on its turn is surrounded by a shell of 12 filaments forming 24 voids in between them. The envelope subscribing the outer periphery of such a cord is a substantially regular hexagon.
- 27 filaments, all of substantially equal diameter twisted together in one single step with identical lay direction and lay length, with a 3×1 in the centre that is surrounded by a first shell of 9 filaments, that on its turn is surrounded with a shell of 15 filaments. There are 36 voids in between the filaments. The envelope subscribing the outer periphery is a hexagon, the sides of which alternatively count 4 and 3 filaments.

Such constructions are generically known as compact cords. They are characterised by their parallel lay (all filaments in the same direction and with the same lay direction) and their filament diameters that are equal. When allowing different diameters but keeping the parallel lay, other industrial important configurations emerge that are characterised by a very high metallic density (reference is made to the page numbers in "Drahtseile" of Prof. Dr.-Ing. D. G. Shitkow and Ing. I. T. Pospechow, V. E. B. Verlag Technik Berlin, 1957):

- Warrington type where a central core is surrounded by two layers, where the outer layer consists of twice the number of filaments of the first layer and the outer layer diameters are alternatively small and large (page 251 to 263)
- Seale type wherein a central core is surrounded by two layers having an equal number of filaments, the filament diameters within one layer being substantially equal and the filament diameters of the outer layer are larger than those of the inner layer (page 229 to 237).
- Filler type where a central core is surrounded by two layers, where the diameters of filaments within one layer are substantially equal and the number of filaments in the second layer is twice the number of filaments in the first layer, and wherein the position of the filaments in the layers is stabilised by the presence of thin filler wires (page 241 to 251).

Combinations of the above types such as Warrington-Seale are equally well possible.

The above mentioned sub-structures can also be used as intermediate products in the further production of the cord. They can be used as e.g. a core around which other layers of steel filaments can be twisted (with a different lay length or lay direction) as in a 3+9+15 or 1+6+15 type of cord.

The cord can also be a cord comprising at least two strands, wherein inside the strands sub-structures built up of at least three filaments are present. Structures in this respect are cords of the type N×F, wherein the filaments of one strand have the same lay direction and lay length. The following configurations are particularly important: 3×3, 7×3, 7×4, 7×7, 7×19. In this respect the configurations 12×3, 19×3, as described in EP 0770726 are also cords on which the inventive principles of the current application can be applied. Also cords with a core strand that is different from the outer strands are of interest such as e.g. 1×3+5×7, 19+8×7. The core can on its turn be a cable such as in 7×7+6×19.

A preferred way to apply the protective compound on a cord is by immersing the cord in a solution comprising the protective compound or by applying the protective compound from its molten state. Furthermore, the protective compound can be applied by spraying, for example by spraying a solution comprising the protective compound or by spraying the protective compound in its molten state.

In case the protective compound is applied from a solution (for example by immersing of a solution or by spraying from a solution) the protective compound is present in a concentration ranging between 0 wt % and 100 wt %. More preferably the protective compound is present in a concentration ranging between 10 wt % and 50 wt % as for example between 10 and 20 wt %.

Immersion can be done either by leading the cord through a dipping tank comprising the solution or it can be done by leading the cord through a funnel that is continuously fed with a solution comprising the protective compound. Preferably, the cord is then led in the direction opposite to the flow of the solution comprising the protective compound.

Optionally, while being immersed the sub-structure or sub-structures is/are opened and subsequently closed in order to allow the solution comprising the protective compound to enter into the sub-structures and thus to fill the void or voids. Alternatively, the sub-structure or sub-structures can be opened before immersing and closed after immersing.

Opening of the sub-structures can be obtained by any technique known in the art.

A first method comprises the opening and closing of the sub-structure(s) by repeatedly bending the cord over wheels. The wheels preferably have a sufficiently small diameter e.g. 1 to 50 times or more preferably 10 to 40 times the diameter of the cord so that due to the bending the sub-structures are stretched open and the protective compound can penetrate the void(s). Although one wheel can provide sufficient opening, it is more preferred if 2 to 10 wheels mounted one after the other are used. The wheels can be mounted such that all of them lay in the same plane or the wheels can be mounted in planes that are under an angle to one another. The latter is more preferred because a more uniform treatment over the circumference of the cord is obtained.

A second method to open the sub-structures comprises continuously twisting the sub-structure to allow the protective compound to enter the voids of the cord. This can be done continuously by feeding the cord through a rotationally restraining device that rotates, i.e. a false twister.

Additional means for improving the ingress of the protective compound in the voids of the cord can further be used such as agitation of the bath by for example ultrasonic transducers or vibration of the cord itself.

Possibly, the cord is dried after the application of the protective compound. Drying can be done by any means known in the art for example by conduction, by convection or by radiation. Preferred drying comprises inductive heating, infrared heating or heating by hot gasses such as heated air.

Possibly, the procedure of applying protective compound (and drying) is repeated in order to increase the overall amount of protective compound in the cord.

The metal filament may be made of any metal or metal alloy known in the art. The metal filaments are preferably made of steel as for example plain carbon steel. Such a steel generally comprises a minimum carbon content of 0.40 wt % C or at least 0.70 wt % C but most preferably at least 0.80 wt % C with a maximum of 1.1 wt % C, a manganese content ranging from 0.10 to 0.90 wt % Mn, the sulphur and phosphorus contents are each preferably kept below 0.030 wt %; additional micro-alloying elements such a chromium (up to 0.20 to 0.4 wt %), boron, cobalt, nickel, vanadium—a non-exhaustive enumeration—may also be added. Also preferred are stainless steels. Stainless steels contain a minimum of 12 wt % Cr and a substantial amount of nickel. More preferred are austenitic stainless steels, which lend themselves more to cold forming. The most preferred compositions are known in the art as AISI (American Iron and Steel Institute) 302, AISI 301, AISI 304 and AISI 316.

The metal filaments have preferably a diameter that ranging between 0.04 mm and 1.20 mm depending on the application.

The coated metal filaments comprise metal filaments coated with a coating comprising zinc, aluminum, magnesium or alloys thereof.

Preferably, the metal filaments are with a zinc or zinc alloy coating. As zinc alloy coating one can consider for example Zn—Fe, Zn—Ni, Zn—Al, Zn—Mg, Zn—Mg—Al alloys.

A preferred zinc alloy coating is a Zn—Al alloy coating comprising between 2 and 15% Al.

Possibly, between 0.1 and 0.4% of a rare earth element such as Ce and/or La can be added.

A great advantage of a cord according to the present invention is that the cord is free of hexavalent chromium as hexavalent chromium is not required to protect the coated metal filaments. This means that the cord and/or filaments do not require a treatment with a chromium based compound.

Furthermore when a cord according to the present invention is used for the reinforcement of a cementitious matrix also the cementitious matrix is also free of hexavalent chromium.

According to a second aspect of the present invention, a structure comprising at least one cord as described above is provided. The structure is preferably a reinforcing structure, for example a structure for reinforcing a cementitious matrix.

The structure can be any structure comprising at least one cord according to the present invention such as a woven, a knitted, a braided, a welded or a glued structure.

The structure may consist of cords according to the present invention or alternatively the structure may comprise cords according to the present invention and other cords and/or filaments such as metal cords and/or metal filaments or non-metal cords and/or non-metal filaments.

According to a third aspect of the present invention a cementitious matrix reinforced with at least one cord as described above is provided. A cord as described above is brought in a cementitious matrix and is surrounded by the cementitious matrix, creating an interface coated metal filament—cementitious matrix.

A great advantage of a cord according to the present invention is that the cord is free of hexavalent chromium as hexavalent chromium is not required to protect the coated metal filaments. This means that the cord and/or filaments do not require a treatment with a chromium based compound.

A further advantage of a reinforced structure according to the present invention is that a good protection of the coated metal elements is also obtained in case cement free of hexavalent chromium is used.

In case cement comprising hexavalent chromium is used, even in case no chromium based compounds are added to protect the coated metal elements, coated metal elements could take advantage of the chromium naturally present in cement.

New legislation is imposing to limit the amount of hexavalent chromium in cement to minimize the occurrence of chromate related allergic dermatitis. Consequently, coated metal filaments in a cementitious matrix can no longer take advantage of the chromium naturally present in cement.

To obtain cement free of hexavalent chromium cement producers have developed techniques such as dosing with ferrous sulphate. The addition of ferrous sulphate increases dramatically the amount of hydrogen gas evolution.

It is a great advantage of the present invention that hydrogen gas evolution is also prevented in case cement free of hexavalent chromium is used and in case cement is dosed with ferrous sulphate.

The reinforced cementitious matrix can be used for any application known in the art such as prefabrication constructions, bridges, buildings, tunnels, parking garages, offshore oil platform, . . . .

For the purpose of this invention, "cementitious matrix" should be understood to mean the matrix material apart from the metal elements. The cementitious matrix may comprise any material comprising cement as for example concrete or mortar.

According to a further aspect of the present invention a method for inhibiting hydrogen gas evolution at the interface of a cord comprising coated filaments embedded in a cementitious matrix is provided. The method comprises the steps of providing at least one cord as described above, introducing said cord in a cementitious matrix.

BRIEF DESCRIPTION OF FIGURES IN THE DRAWINGS

Figure 2:
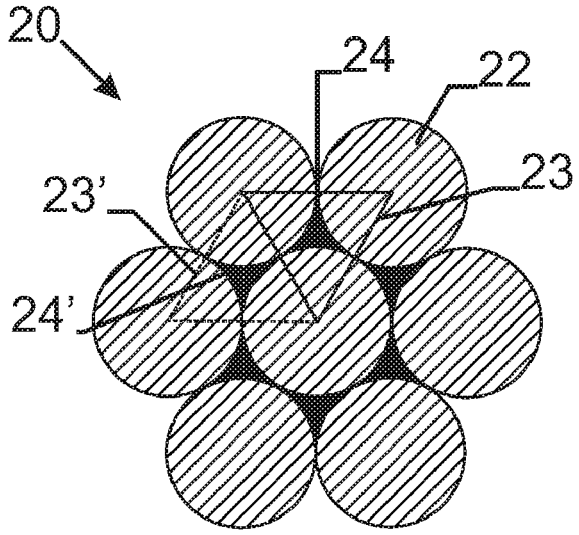
Figure 3:
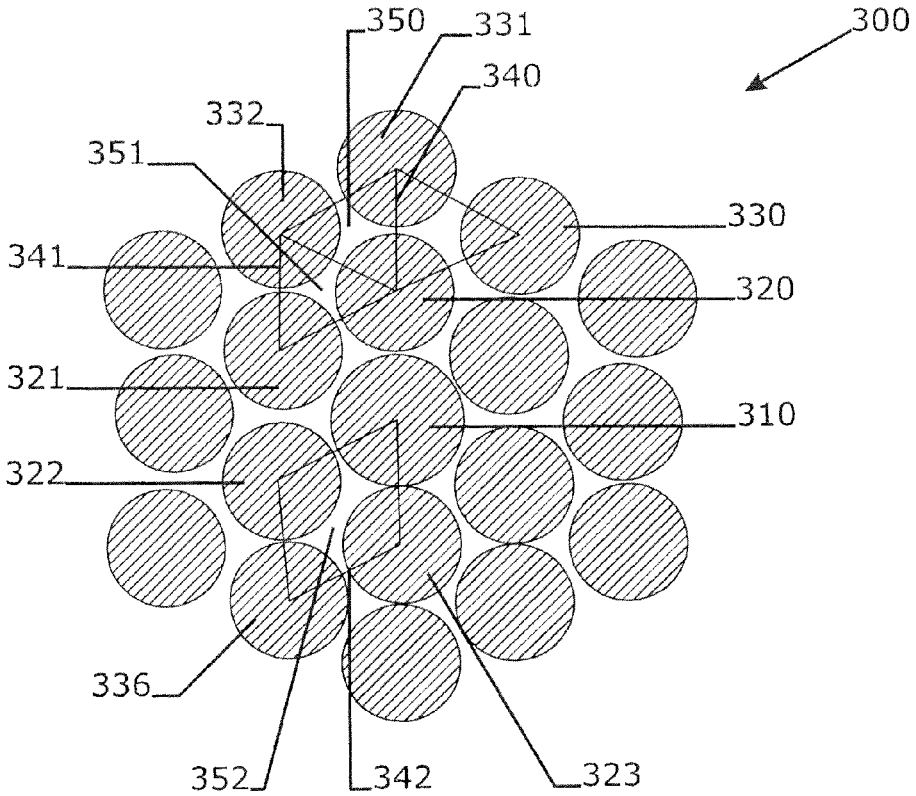
Figure 4:
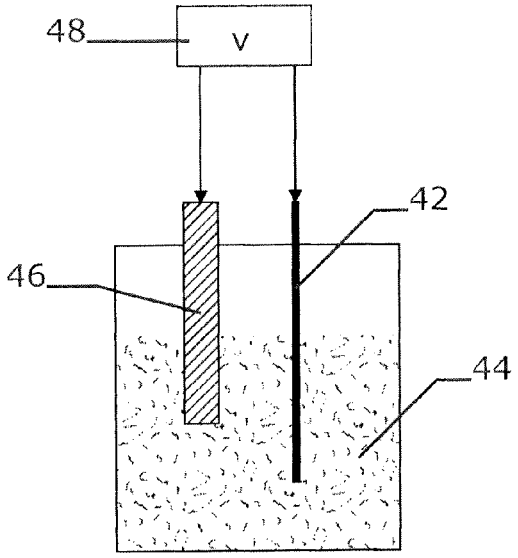

The description will now be described into more detail with reference to the accompanying drawings wherein FIG. 1, FIG. 2 and FIG. 3 show cross-sections of cords according to the present invention;

FIG. 4 is an illustration of the measurement of the potential in a fresh construction matrix

MODE(S) FOR CARRYING OUT THE INVENTION

Referring to FIG. 1, FIG. 2 and FIG. 3 some examples of cords according to the present invention are described.

EXAMPLE 1

FIG. 1 shows a cross-section of a cord 10 for the reinforcement of a cementitious matrix according to the present invention. The cord 10 comprises three zinc coated metal filaments 12 twisted together. The three filaments form a closed sub-structure 13 whereby neighbouring filaments 12 of the closed sub-structure 13 are maximum 30 μm remote from each other. A void 14 is hereby formed in the middle of the three filaments 12 of the closed sub-structure 13. A protective compound, as for example benzimidazole is present in said void. Possibly, the protective compound is also present on at least a part of the zinc coated metal filaments 12.

EXAMPLE 2

FIG. 2 shows a cross-section of a cord 20 for the reinforcement of a cementitious matrix according to the present invention. The cord 20 comprises 7 filaments 22. Neighbouring filaments form closed sub-structures 23, 23'. Neighbouring filaments 22 of a closes-substructure are maximum 100 μm remote form each other. Voids 24, 24' are formed in the middle of filaments of a closed substructure 23, 23'. A protective compound is present in the voids 24, 24' of the closed substructures 23. Possibly, the protective compound is also present on at least a part of the zinc coated metal filaments 22.

EXAMPLE 3

FIG. 3 shows a cross-section of a brass coated compact cord 300 having a 0.34+18×0.30 construction. Around the central somewhat thicker filament 310 of 0.34 mm diameter, 18 filaments of diameter 0.30 have been cabled in one operation with a lay length of 21 mm in the Z direction. The cable has many voids. The filaments 320, 331 and 332 form a closed sub-structure 340 having a void 350 as the neighbouring filaments 320, 331 and 332 are less than 30 μm remote form each other. Similarly the filaments 320, 321 and 332 form a closed sub-structure 341 having a void 351 as the neighbouring filaments 320, 321 and 332 are less than 30 μm remote from each other. Also the filaments 310, 322, 336 and 323 form a closed substructure 342 having a void 352 as the neighbouring filaments 310, 322, 336 and 323 are less than 30 μm remote from each other. On the other hand the filaments 320, 330, 331 does not form a closed sub-structure as the filaments 330 and 331 are more than 100 μm remote from each other.

For a wire and for the cords of example 1 and example 2, the c value is determined with the method of double weighing as described above. Protective compound is applied on a wire, on a cord of example 1 and on a cord of example 2 using three different solutions comprising protective compound. The first solution used comprises 5 wt % benzimidazole in ethanol, the second solution comprises 10 wt % benzimidazole in ethanol and the third solution comprises 20 wt % benzimidazole in ethanol.

Table 1 shows the x and y value for the three tested samples using the three different solutions of protective compound. Table 2 shows the c value for this three tested samples using the three different solutions of protective compound.

TABLE 1

| | 5 wt % benzimidazole in ethanol | 10 wt % benzimidazole in ethanol | 20 wt % benzimidazole in ethanol |
|---|---|---|---|
| | x = 1.4 g/m$^2$ | x = 1.8 g/m$^2$ | x = 5.3 g/m$^2$ |
| Wire | y = 0 g/m$^2$ | y = 0 g/m$^2$ | y = 0 g/m$^2$ |
| Cord example 1 | y = 0 g/m$^2$ | y = 3.0 g/m$^2$ | y = 7.3 g/m$^2$ |
| Cord example 2 | y = 0 g/m$^2$ | y = 25.2 g/m$^2$ | y = 57.6 g/m$^2$ |

TABLE 2

| | 5 wt % benzimidazole in ethanol | 10 wt % benzimidazole in ethanol | 20 wt % benzimidazole in ethanol |
|---|---|---|---|
| Wire | c = 1 | c = 1 | c = 1 |
| Cord example 1 | c = 1 | c = 2.67 | c = 2.38 |
| Cord example 2 | c = 1 | c = 14.99 | c = 11.87 |

From Table 1 it can be concluded that x is increasing when using a solution with an increasing concentration of protective compound.

With respect to y: for a wire y=0 g/m$^2$. This means that no compound container-effect is observed for a wire.

When a solution of 5 wt % benzimidazole is used, the y value for a cord of example 1 and for a cord of example 2 is equal to =0 g/m$^2$.

Consequently, the value c equals 1. Thus when using a solution of 5 wt % benzimidazole no compound container-effect is observed.

When using a solution of 10 wt % benzimidazole or 20 wt % benzimidazole, the y value of the cord is not zero. Consequently, the value c is higher than 1. This means that a compound container-effect is observed. From this it can be concluded that a minimum concentration of protective compound is required to observe a compound container-effect.

In a reinforced structure according to the present invention a cord according to the present invention or a structure comprising at least one cord according to the present invention is embedded in a cementitious matrix as for example concrete. The wet concrete is acting as the electrolyte in which corrosion may occur.

Water is capable of decomposing into hydrogen and oxygen. The decomposition of water is an electrochemical redox reaction which occurs at a certain potential. The electrochemical potential at which the decomposition takes place is determined by the pH according to the law of Nernst.

The decomposition potential of water at which hydrogen gas is formed is according to the law of Nernst:

$$E_{H_2}=E_{H_2}{}^{0}-0.059*\text{pH}$$

whereby $E_{H_2}{}^{0}=0$ versus a standard hydrogen electrode.

The decomposition potential of water at which oxygen is formed is according to the law of Nernst:

$$E_{O_2}=E_{O_2}{}^{0}-0.059*\text{pH}$$

whereby $E_{O_2}{}^{\circ}=+1.226$ V versus a standard hydrogen electrode.

A list of the E° or standard potentials can be found in: "The handbook of Chemistry and Physics, the electrochemical series, p. D151-D158, 67th edition, 1986".

The decomposition potentials of water in function of pH are described in "Atlas of electrochemical equilibria in aqueous solutions by Marcel Pourbaix-Cebelor, $2^{nd}$ edition 1997, p. 98-105".

When a strong electronegative element like zinc, aluminum or magnesium is exposed to water, the element has an open circuit potential as defined in the standard ASTM G15-93. The open circuit potential is also referred to as rest potential or standard potential. At high pH values, the open circuit potential drops below the hydrogen evolution potential and hence initiates the reduction of hydrogen ions resulting in hydrogen gas evolution. The hydrogen gas evolution is calculated, based on a pH measurement of the environment whereto the material will be exposed.

The pH of a cementitious matrix is measured according to test method ASTM G51-95. This method covers a procedure for determining the pH of a soil in corrosion testing. For the purpose of this application the test method ASTM G51-95 is applied for a cementitious matrix instead of a soil.

For a sample comprising one part cement and four parts sand (instead of soil according to ASTM51-95), a pH of 13.04 was found. According to the law of Nernst $E_{H2}$ can be calculated:

$$E_{H_2}=E_{H^{\circ}}-0.059*\text{pH}$$

$E_{H_2}=-0.7694$ V (versus the standard hydrogen electrode potential)

This means that when the open circuit potential of a reinforcement material being introduced in this type of cementitious matrix drops below the value −0.7694 V hydrogen gas will be formed.

The open circuit potential can easily be measured in situ in the construction material for example during the first hours after the casting of the cementitious matrix. The most critical period in which hydrogen gas evolution is detrimental is the first 24 till the first 72 hours after casting. Once the composite is hardened, the risk of hydrogen gas evolution is negligible.

The open circuit potential can be measured in situ according to standard ASTM C876. However it is more appropriate to measure the open circuit potential in a small sample as for example shown in FIG. 4. The equipment is used according to standard ASTM G3-89(94). A cord according to the present invention 42 is embedded in a cementitious matrix 44. The electrical potential between the zinc coated metal element 42 and a reference electrode 46 is measured by means of an electrometer or high impedance voltmeter 48.

To evaluate the performance of cords according to the present invention, cords according to the present invention are embedded in a cementitious matrix. The samples all comprise a cementitious matrix obtained by mixing one part of CEM II 42.5R cement with four parts of sand and 5 parts of water. The open circuit potential of the samples is measured in function of the time. The open circuit potential of cords according to the present invention remains above the hydrogen potential during the first 72 hours after casting.

The invention claimed is:

1. A cord for the reinforcement of a cementitious matrix, said cord comprising a number of metal filaments twisted together to form said cord, said metal filaments being coated with a coating comprising zinc, aluminium, magnesium or alloys thereof, said cord having cross-sections, wherein three or more of said filaments form a closed sub-structure so that said filaments of said closed sub-structure contact neighbouring filaments of said closed sub-structure or so that said filaments of said closed sub-structure are a maximum 100 μm remote from neighbouring filaments in order to form a void in the middle of said three or more filaments, said cord further comprising a protective compound, said protective compound being at least present in said void, said protective compound being configured to provide the coated metal with cathodic protection, said protective compound being selected from the group consisting of imidazoles, triazoles, and tetrazoles.

2. A cord according to claim 1, wherein said protective compound comprises benzimidazole.

3. A cord according to claim 1, wherein said cord comprises at least three filaments that are twisted together with a same lay length and lay direction.

4. A cord according to claim 1, wherein said cord comprises a multi-strand cord, said multi-strand cord comprising two or more strands, each strand comprising three or more filaments.

5. A cord according to claim 1, wherein said protective compound is applied from a solution comprising between 10 and 50 wt % of protective compound.

6. A cord according to claim 1, wherein said cord has a value c (container value), said value c being higher than 1, wherein said value c is calculated according to a formula c=(x+y)/x, with x being an amount of protective compound that is applied on a total surface of individual filaments of said cord and y being an amount of protective compound that is stored in the void or voids of the sub-structure(s) of said cord, x and y being expressed in $g/m^2$.

7. A cord according to claim 1, wherein said cord has a value c (container value) higher than 2.

8. A cord according to claim 1, wherein said cord is free of hexavalent chromium.

9. A structure comprising a number of cords as defined in claim 1, wherein said structure is a woven, a knitted, a braided, a welded or a glued structure.

10. A cementitious matrix reinforced with a structure as defined in claim 9.

11. A method to inhibit hydrogen gas evolution at an interface of a cord comprising zinc coated filaments embedded in a cementitious matrix, said method comprising the steps of providing at least one cord as defined in claim 1 and introducing said cord in said cementitious matrix.

* * * * *